US007273574B2

(12) United States Patent
Yamakawa et al.

(10) Patent No.: US 7,273,574 B2
(45) Date of Patent: Sep. 25, 2007

(54) GOLF BALL MANUFACTURING METHOD

(75) Inventors: Jun Yamakawa, Kobe (JP); Yasuhiro Watabe, Kobe (JP)

(73) Assignee: SRI Sports Limited, Kobe (JP)

( * ) Notice: Subject to any disclaimer, the term of this patent is extended or adjusted under 35 U.S.C. 154(b) by 454 days.

(21) Appl. No.: 10/757,420

(22) Filed: Jan. 15, 2004

(65) Prior Publication Data

US 2004/0144224 A1 Jul. 29, 2004

(30) Foreign Application Priority Data

Jan. 16, 2003 (JP) ..... 2003-008374

(51) Int. Cl.
*B29C 67/00* (2006.01)

(52) U.S. Cl. ..... 264/161; 264/162; 83/13

(58) Field of Classification Search ..... 264/162, 264/161; 83/13
See application file for complete search history.

(56) References Cited

U.S. PATENT DOCUMENTS 3,073,072 A * 1/1963 Selby ..... 451/213
4,779,387 A 10/1988 Reid et al.
4,894,958 A 1/1990 Takasaki
5,611,723 A * 3/1997 Mitoma et al. ..... 451/6

FOREIGN PATENT DOCUMENTS

JP 60-232861 A 11/1985
JP 08-299498 A 11/1996

* cited by examiner

*Primary Examiner*—Edmund H. Lee
(74) *Attorney, Agent, or Firm*—Birch, Stewart, Kolasch & Birch, LLP

(57) ABSTRACT

A golf ball manufacturing method comprises a step of holding a spew (B) of a seam (C) of a golf ball (G) in a predetermined position, a step of deciding whether the position of the seam (C) is normal, and a step of distinguishing the necessity of the processing of the golf ball based on the decision, and furthermore, a step of processing the seam (C) which removes the spew (B) of the seam (C) and smoothens a removing mark, and the step of processing the seam (C) is constituted by a plurality of stages including cutting and grinding. The processing is carried out at an angle obtained by inclining an angle for processing the seam C in the direction of the flow of a polymer in the seam C. According to the golf ball manufacturing method, the appearance of the seam is very smooth and the performance of the ball can be more uniform.

5 Claims, 3 Drawing Sheets

GOLF BALL MANUFACTURING METHOD

This Nonprovisional application claims priority under 35 U.S.C. §119(*a*) on Patent Application No(s). 2003-008374 filed in JAPAN on Jan. 16, 2003, the entire contents of which are hereby incorporated by reference.

BACKGROUND OF THE INVENTION

1. Field of the Invention

The present invention relates to a golf ball manufacturing method. More particularly, the present invention relates to a method of removing a spew of a seam and making the seam smooth after the removal.

2. Description of the Related Art

A golf ball is usually formed by upper and lower molds having hemispherical cavities. A molding method such as an injection molding method, a compression molding method or the like is employed. By any molding method, a molding material slightly leaks out of a parting line of the upper and lower molds. Accordingly, a ring-shaped spew is generated in a portion corresponding to the parting line on the surface of the formed golf ball (which will be hereinafter referred to as a "seam"). In the injection molding method, agate is provided on the parting line of a mold. The spew is also generated in a portion corresponding to the gate. These spews are to be removed. The spew can be removed by methods disclosed in Japanese Laid-Open Patent Publications Nos. Sho 60-232861, Sho 63-174801, Sho 63-11266 and Hei 8-299498. In these spew removing methods, a spew is caused to abut on a cutting tool while a held golf ball is rotated. In these methods, the seam of the golf ball is rotated, and at the same time, the cutting tool is caused to abut in parallel with the direction of the rotation of the seam, thereby removing a spew. For the cutting tool, a grindstone, a sandpaper, a cutting tool piece or the like is used.

In the case in which the golf ball is to be formed by a compression mold, the flow of a resin in the seam is usually parallel with the seam. In some cases in which cutting or grinding is carried out in such a direction that the resin of the seam flows, the resin of the seam is removed unexpectedly when the seam abuts on a grinding tool or the like. In such seam removal, there has been found a phenomenon in which the material of the seam is often ground excessively to be scooped out when the grinding is particularly carried out by a rotation. Depending on the blending of the outer cover material of a ball, a molding method or the like, the orientation of the material in a seam portion is varied. In most cases, the flow of the material is parallel with or orthogonal to the seam.

Desirably, the seam of the golf ball is processed in such a manner as not to make a difference from a portion other than the seam of the golf ball after a spew is removed. In the case in which the direction of the processing of the spew is parallel with the spew, there is a phenomenon in which a cutting tool is apt to excessively cut or grind a material constituting the seam or the vicinity of the seam (hereinafter referred to as a "seam portion"). In this case, when the seam portion is processed at a time, the processing width of the seam portion tends to be increased. Such a processing damages the curved surface of the seam portion, which is not preferable. In respect of the aerodynamic characteristic of the golf ball, the uniformity of the surface of the golf ball is important. Also in some cases in which the seam portion has an unremarkable appearance which does not make a difference from other portions, a grinding mark remains microscopically. In the present invention, the grinding includes polishing.

In consideration of such problems, it is an object of the present invention to provide a golf ball having a higher uniformity by processing the seam of the golf ball more smoothly.

SUMMARY OF THE INVENTION

The present invention provides a golf ball manufacturing method comprising an attitude regulating step of regulating an attitude of a golf ball having a spew on a seam in such a manner that the seam is placed in a predetermined position, and a seam processing step of cutting or grinding the spew or the seam by means of a rotary processing tool having a processing direction to be inclined to the seam while rotating the golf ball in a circumferential direction of the seam. According to the manufacturing method, the processing width of the seam portion is maintained to be small and a removing mark is smooth. Therefore, it is possible to enhance the uniformity of the appearance and flight performance of the golf ball.

It is preferable that an absolute value of an angle formed by the processing direction with respect to the seam should be 10 to 45 degrees. It is more preferable that the absolute value should be 15 to 45 degrees. Consequently, it is possible to carry out a seam processing which is not influenced by the flow of the material of the formed golf ball.

The present invention provides another golf ball manufacturing method comprising an attitude regulating step of regulating an attitude of a golf ball having a spew on a seam in such a manner that the seam is placed in a predetermined position, a first processing step of cutting or grinding the spew or the seam by means of a rotary processing tool having a processing direction to be inclined to the seam while rotating the golf ball in a circumferential direction of the seam, and a second processing step of cutting or grinding the spew or the seam by means of a rotary processing tool having a processing direction to be inclined to the seam and to cross the processing direction at the first processing step with the seam interposed therebetween while rotating the golf ball in the circumferential direction of the seam. Consequently, it is possible to reliably smoothen a processing mark such as a small grinding mark.

Also in this case, it is preferable that absolute values of angles formed by the processing directions at the first and second processing steps with respect to the seam should be 10 to 45 degrees. It is more preferable that the absolute values should be 15 to 45 degrees.

Furthermore, it is preferable that the processing direction at the first processing step and the processing direction at the second processing step should be almost symmetrical with the seam interposed therebetween. By this method, the seam becomes smoother.

DESCRIPTION OF THE PREFERRED EMBODIMENTS

A preferred embodiment of the present invention will be described below in detail with reference to the drawings.

Figure 1:
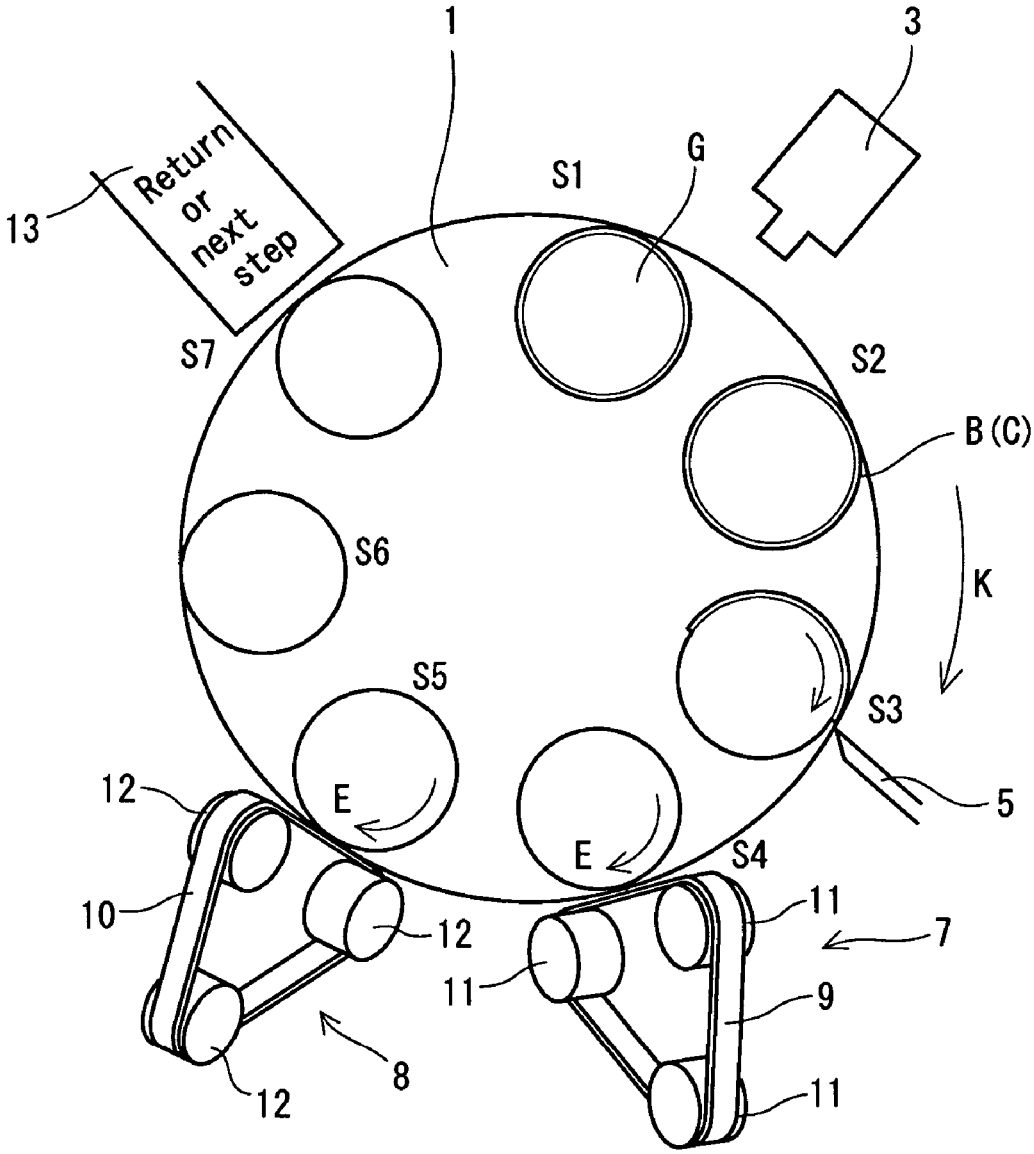
FIG. 1 is a plan view showing a part of a manufacturing apparatus to be used in a golf ball manufacturing method according to an embodiment of the present invention.

A manufacturing apparatus shown in FIG. 1 comprises a turntable 1, stations S1 to S7, a camera 3, a cutter 5, a sand belt device 7, another sand belt device 8 and a chute 13. The turntable 1 is rotated in a direction of Kin FIG. 1. The rotation is intermittently carried out at 360/7 degrees. By the intermittent rotation, the first to seventh stations (S1 to S7) are formed.

Figure 2:
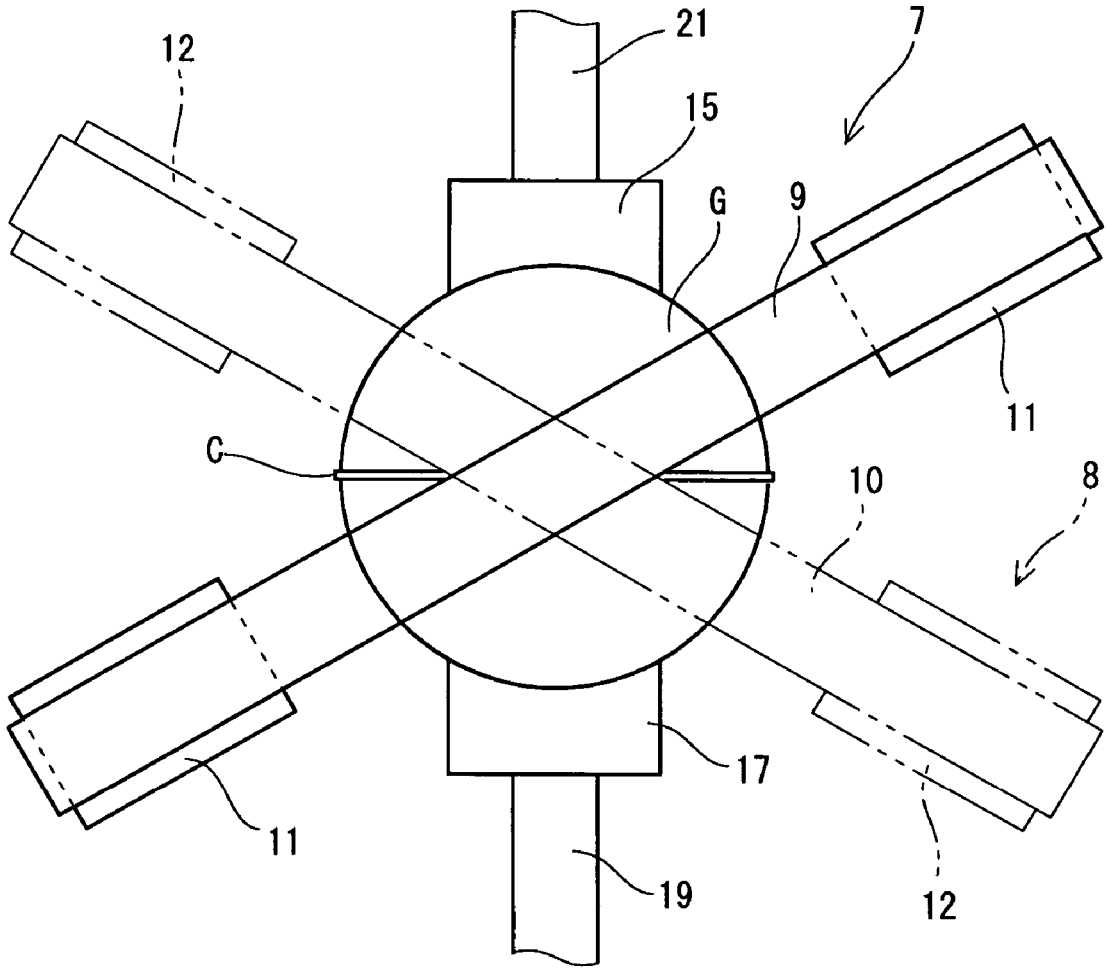
FIG. 2 is an enlarged front view showing a fourth station of the apparatus in FIG. 1.

FIG. 2 shows an upper holding tool 15, a lower holding tool 17, a spindle 19 and a cylinder 21. The upper holding tool 15 is coupled to the cylinder 21 and can be moved vertically. The upper holding tool 15 is rotatable with respect to the cylinder 21. The lower holding tool 17 is rotated by the rotation of the spindle 19 coupled at a lower part. Each of the other stations (S1 to S3 and S5 to S7) is also provided with the upper holding tool 15, the lower holding tool 17, the spindle 19 and the cylinder 21, which is not shown.

In the manufacturing method, first of all, a golf ball (hereinafter referred to as a ball) G is formed. During molding, a cover material (typically, a synthetic resin composition) leaks out of the parting line of molds so that a ring-shaped spew is formed. The ball G is transferred to an attitude control device. In the attitude control device, the ball G is rolled over a pair of rollers arranged in parallel and an attitude is controlled in such a manner that a spew B becomes horizontal.

The ball G is transported to the first station through the attitude control device with a seam C maintained to be horizontal. The ball G is put on the lower holding tool 17 in the first station S1 (see FIG. 2) and the upper holding tool 15 is brought down so that the ball G is interposed and fixed between both of the holding tools 15 and 17.

By the rotation of the turntable 1, the ball G in the first station S1 is moved to the second station S2. In the second station S2, the ball G is photographed by means of the camera 3. Image data obtained by the photographing are transmitted to a computer and it is automatically decided whether the spew B is horizontal. The ball G is transferred to the third station S3 by the rotation of the turntable 1.

In the present embodiment, the ball G is subjected to a seam processing from the third station S3 to the fifth station S5. A cutting tool or a grinding tool is caused to abut on the seam C while the ball is rotated, and the seam portion is cut or ground and is thus smoothened.

At a first processing step having a main object to remove a spew, the blade of the cutter 5 is caused to abut on the seam C during a rotation in the third station S3 in the present embodiment. Consequently, the spew B is removed. The cutter 5 includes a diamond cutter, a carbide cutting tool and the like. When the cutter 5 is rotated, the amount of removal of the seam material is influenced by a direction in which the same material flows during the molding. In the case in which the blade is caused to abut on the spew, the amount of the removal is not influenced by an angle until a sharpness is lost.

Next, the ball is transferred to the fourth station related to a second processing step having a main object to smoothen the seam. In the present embodiment, as shown in FIG. 2, the sand belt device 7 is used as a seam grinding tool in the fourth station. The sand belt device 7 is constituted by a sand belt 9 and a roller 11 for supporting and driving the sand belt 9. The sand belt 9 is a non-end belt obtained by adhering abrasive grains having a predetermined grain size such as alumina or silicon carbide to a cloth or a base material such as polyester, for example. The seam grinding tool is provided with an inclination to the seam. The direction of the inclination in FIG. 2 is set to be right and upward.

The ball G is rotated, and at the same time, the sand belt 9 is caused to abut on the seam C by means of the sand belt device 7. In the fourth station, it is preferable that the angle of the sand belt 9 to abut should be set to be 10 to 80 degrees. The reason is that an overlap with the direction of the flow of the outer cover material of the ball can be prevented and the material can be hindered from being excessively ground. In respect of a processing efficiency, the angle is more preferably 10 to 75 degrees, further preferably 10 to 45 degrees and particularly preferably 15 to 45 degrees.

The sand belt device 7 can be used in any of stages in the seam processing. In the present embodiment, a No. 400 count sand belt 9 is used to grind the seam obtained after the spew is cut and removed in the third station and the mark of the spew has a height of 0.5 mm or less, for example.

Figure 3:
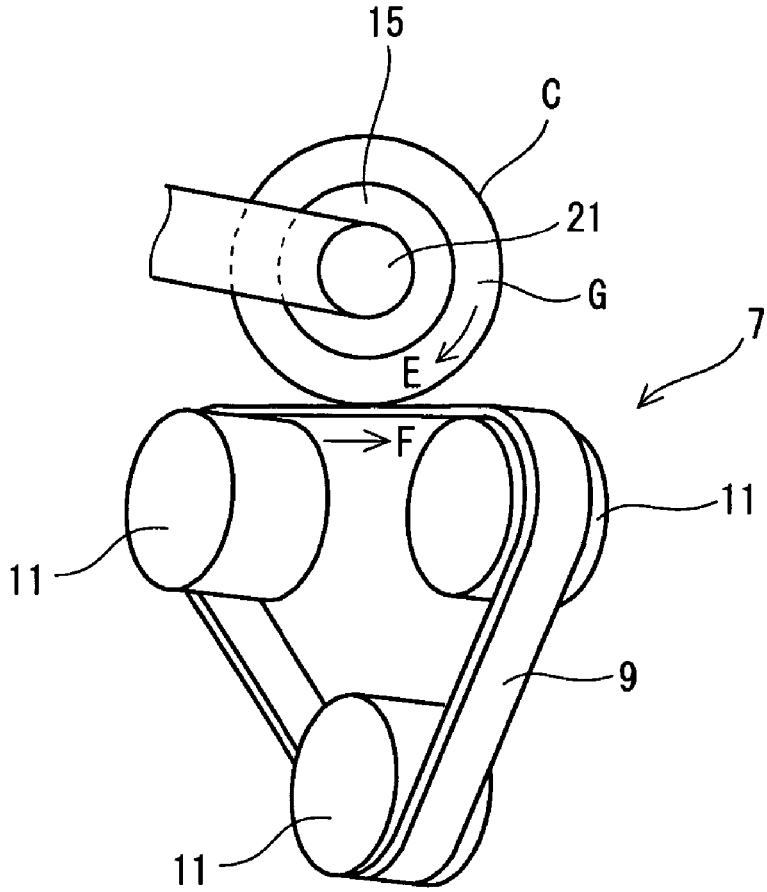
FIG. 3 is an enlarged plan view showing the fourth station of the apparatus in FIG. 1.

The sand belt 9 of the sand belt device 7 is rotated in a direction of an arrow F which is reverse to an arrow E in the direction of the rotation of the ball G (see FIG. 3). Usually, the peripheral velocity of the ball G is set to be 100 to 600 mm/s. At this time, the speed of the sand belt is set to be 2000 to 7000 mm/s.

Similarly, the ball G is transferred to the fifth station and is rotated, and at the same time, the second sand belt 10 is caused to abut on the seam C by means of the sand belt device 8. In the drawing, the sand belt device 8 in the fifth station S5 is superposed on the sand belt device 7 in the fourth station S4 for convenience. The present stage is a grinding finishing stage subsequent to the processing stage. Herein, a No. 600 count sand belt 10 having smaller abrasive grains is used. It is preferable that the height of the projection of a spew mark should be set to be 0.1 mm or less before starting the final grinding stage of the seam.

An angle at which the sand belt is caused to abut is obtained by crossing the angle of the abutment in the fourth station with the seam interposed therebetween. Accordingly, an angle is set to be −80 to −10 degrees with respect to the seam C, preferably −75 to −10 degrees, and more preferably −45 to −10 degrees. It is further preferable that the angle should be −45 to −15 degrees. In a multistage, thus, the processing directions are crossed with the seam interposed therebetween. Consequently, the removing mark of the spew is not remarkable, and the surface of the seam C is ground and is thus finished smoothly.

It is further preferable that the angles of the processing directions to be crossed should be almost symmetrical with the seam interposed therebetween because of a great advantage of smooth finishing. More specifically, if one of the angles is $+\alpha$ degrees, the other angle is set to be approximately $-\alpha$ degrees. More specifically, it is preferable that a difference between the absolute value of one of the angles and that of the other angle should be 10 degrees or less. It is more preferable that the difference should be 5 degrees or less. Furthermore, it is the most preferable that the difference should be substantially 0 degree.

The ball G decided to be rejected in the second station S2 is not processed from the third station to the fifth station. The ball G is subsequently transferred to the seventh station through the sixth station. The ball G is flicked from the turntable 1 into the chute 13 having a sorting function in the seventh station. At this time, the ball G in which the spew B is not processed is sent toward a return side over the chute 13. The ball G thus returned is sent back to an attitude regulating device for the ball and is processed again. The ball G from which the spew B is removed is transferred to a next step through the normal side of the chute 13.

In the sixth station, any processing is not carried out in the present embodiment. In the case in which the seam processing stage is to be further subdivided into four stages, the sixth station can be used. Moreover, the seam processing step may be ended in two stages. In this case, another empty station is added.

EXAMPLES

Example 1

The seam of a ball was processed by using the manufacturing apparatus shown in FIG. 1. An attitude was regulated and the horizontal position of a spew was checked, and a spew mark was then set to be 0.3 mm or less by using the cutter of a diamond cutting tool for the seam in a third station. Subsequently, the ball was transferred to a fourth station and a fifth station, and the seam was processed with grinding angles varied through sand belts having different abrasive grains respectively. Table 2 shows a processing tool used in each stage of the seam processing and an inclination angle in a processing direction. Moreover, the Table 2 also shows the evaluation of the processing state of the seam of the ball. The ball had a surface condition of A and a seam thickness of 0.2 mm or less. The case in which the surface condition is very smooth is evaluated as A, the case in which a processing mark is microscopically present and a surface condition is smooth is evaluated as B, and the case in which the processing mark can be seen is evaluated as C. The seam thickness represents a width by which the seam is processed, and is preferably small.

Example 2

A processing was carried out and an evaluation was performed in the same manner as in the example 1 except that a cutter was used at an inclination angle of 15 degrees in a third station S3, a sand belt was used at an inclination angle of −15 degrees in a fourth station S4 and any processing was not carried out in a fifth station S5 in a stage for processing a seam C.

Example 3

Example 3 is the same as the example 1 except that sand belts were inclined alternately in processing directions and were used in four stages from a third station S3 to a sixth station S6 to perform a seam processing.

Comparative Example 1

A processing was carried out in the same manner as that in the example 1 except that grinding was performed by using a diamond grindstone having an inclination angle in a processing direction of 0 degree in a third station S3 and any processing was not executed in a fourth station S4 and a fifth station S5.

Comparative Example 2 and Comparative Example 3

The same processing as that in the example 1 was carried out except that a seam C was processed in a plurality of stages and a processing direction with respect to the seam C has an angle which is parallel with the seam C as shown in Table 1.

TABLE 1

| | | Result of Evaluation | | |
|---|---|---|---|---|
| | | Comparative example1 | Comparative example2 | Comparative example3 |
| Third station S3 | Cutting tool | Diamond grindingstone | Cutter (note 2) | Cutter (note 2) |
| | Processing angle | 0° (note 1) | 0° | 0° |
| Fourth station S4 | Cutting tool | — | Sand beltA (note 3) | Sand beltB (note 4) |
| | Processing angle | — | 0° | 0° |
| Fifth station S5 | Cutting tool | — | — | Sand beltC (note 5) |
| | Processing angle | — | — | 0° |
| Sixth station S6 | Cutting tool | — | — | — |
| | Processing angle | — | — | — |
| Surface condition | | C | B | B |
| Seam thickness (mm) | | 0.8 | 0.5 | 0.4 |

TABLE 2

| | | Result of Evaluation | | |
|---|---|---|---|---|
| | | Example1 | Example2 | Example3 |
| Third station S3 | Cutting tool | Cutter (note 2) | Cutter (note 2) | Sand beltB (note 4) |
| | Processing angle | 0° | 15° | 10° |
| Fourth station S4 | Cutting tool | Sand beltB (note 4) | Sand beltC (note 5) | Sand beltB (note 4) |
| | Processing angle | −20° | −15° | −10° |
| Fifth station S5 | Cutting tool | Sand beltC (note 5) | — | Sand beltA (note 3) |
| | Processing angle | 20° | — | 10° |
| Sixth station S6 | Cutting tool | — | — | Sand beltC (note 5) |
| | Processing angle | — | — | −10° |

TABLE 2-continued

| | Result of Evaluation | | |
|---|---|---|---|
| | Example1 | Example2 | Example3 |
| Surface condition | A | A | A |
| Seam thickness (mm) | 0.2 | 0.3 | 0.2 |

Note 1) Diamond grindstone ("DIAMOND #120" manufactured by Allied Material Co., Ltd.),
Note 2) Cutter (Diamond cutting tool "DC CUTTER" width: 6 mm, rake angle: 20 degrees manufactured by the Allied Material Co., Ltd.),
Note 3) Sand belt A (Sand belt "ALUMINA #400" manufactured by Riken Corundum Co., Ltd.),
Note 4) Sand belt B (Sand belt "ALUMINA #240" manufactured by the Riken Corundum Co., Ltd.), and
Note 5) Sand belt C (Sand belt "ALUMINA #600" manufactured by Riken Corundum Co., Ltd.).

As shown in the Tables 1 and 2, in a ball manufacturing method according to each example, a certain angle or more is set to a seam. According to the methods of the first to third examples, therefore, the seam of the ball has a very smooth surface condition. Moreover, the processing thickness of the seam is small. As compared with the case of a processing direction along the seam, the amount of grinding of a seam material can be more prevented from being excessively increased in a processing direction which is inclined. Furthermore, it can be supposed that the processing thickness is reduced because the seam is ground efficiently in a small contact area through the inclination. On the other hand, in the surface condition of the seam according to the method of each of the comparative examples, the smoothness of a processing mark is insufficient, and furthermore, a seam processing width is great.

The above description is only illustrative and can be variously changed without departing from the scope of the present invention.

What is claimed is:

1. A golf ball manufacturing method comprising:

an attitude regulating step of regulating an attitude of a golf ball having a spew on a seam in such a manner that the seam is placed in a predetermined position; and a seam processing step of cutting or grinding the spew or the seam by means of a rotary processing tool having a processing direction that is inclined to the seam while rotating the golf ball in a circumferential direction of the seam.

2. The golf ball manufacturing method according to claim 1, wherein an absolute value of an angle formed by the processing direction with respect to the seam is 10 to 45 degrees.

3. A golf ball manufacturing method comprising:

an attitude regulating step of regulating an attitude of a golf ball having a spew on a seam in such a manner that the seam is placed in a predetermined position;

a first processing step of cutting or grinding the spew or the seam by means of a rotary processing tool having a processing direction that is inclined to the seam while rotating the golf ball in a circumferential direction of the seam; and a second processing step of cutting or grinding the spew or the seam by means of a rotary processing tool having a processing direction that is inclined to the seam and to cross the processing direction at the first processing step with the seam interposed therebetween while rotating the golf ball in the circumferential direction of the seam.

4. The golf ball manufacturing method according to claim 3, wherein absolute values of angles formed by the processing directions at the first and second processing steps with respect to the seam are 10 to 45 degrees.

5. The golf ball manufacturing method according to claim 3 or 4, wherein the processing direction at the first processing step and the processing direction at the second processing step are almost symmetrical with the seam interposed therebetween.

* * * * *